United States Patent [19]
Ziolo et al.
[11] 4,267,247
[45] May 12, 1981

[54] LOW SPECIFIC GRAVITY MAGNETIC CARRIER MATERIALS

[75] Inventors: Ronald F. Ziolo, Webster; Richard B. Lewis, Williamson, both of N.Y.

[73] Assignee: Xerox Corporation, Stamford, Conn.

[21] Appl. No.: 722,234

[22] Filed: Sep. 10, 1976

[51] Int. Cl.[3] ..... G03G 9/10
[52] U.S. Cl. ..... 430/120; 252/62.55; 252/62.56; 428/403; 428/404; 428/406; 428/407; 430/108; 430/111; 430/122
[58] Field of Search ..... 427/18, 128, 132, 217, 427/215, 229; 428/900, 403, 404, 406, 407; 252/62 R, 62.55, 62.56; 148/105; 430/108, 111, 120, 122

[56] References Cited

U.S. PATENT DOCUMENTS

| | | | |
|---|---|---|---|
| 2,918,392 | 12/1959 | Beller | 427/229 |
| 2,978,323 | 4/1961 | Schmeckenbecher | 252/62.55 X |
| 3,214,379 | 10/1965 | Lindquist | 252/62.55 X |
| 3,261,894 | 7/1966 | Siedl | 427/217 X |
| 3,342,587 | 9/1967 | Goodrich et al. | 427/217 X |
| 3,404,034 | 10/1968 | Maurer et al. | 427/217 X |
| 3,549,412 | 12/1970 | Frey et al. | 427/217 X |
| 3,947,370 | 3/1976 | Miller | 427/18 X |

FOREIGN PATENT DOCUMENTS 726806 6/1969 Belgium .

*Primary Examiner*—John D. Smith

[57] ABSTRACT

Electrostatographic carrier materials having low bulk densities and high magnetic permeabilities are obtained by impregnating low density porous silicaceous particles with a magnetic or magnetically-attractable transition metal or metal oxide thereof. The low density magnetic composite carrier particles are prpepared by the thermal decomposition of transition metal carbonyls in the presence of the silicaceous particles with a suitable suspending medium. Air and moisture are excluded from the reaction vessel and the contents are heated with agitation so that the carbonyl boils and the mixture is refluxed until the temperature rises to that of the suspending medium whereupon impregnation of the silicaceous particles with elemental metal and/or metal oxide is complete. The mixture is cooled, the beads washed, air-dried, and recovered. When mixed with toner particles the aforementioned carrier materials experience significantly reduced toner impaction levels.

7 Claims, 2 Drawing Figures

LOW SPECIFIC GRAVITY MAGNETIC CARRIER MATERIALS

BACKGROUND OF THE INVENTION

This invention relates in general to electrophotography, and more particularly, to a process for preparing carrier materials useful in the magnetic-brush type development of electrostatic latent images.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely-divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,522 is known as "cascade" development. In this method, a developer material comprising relatively large carrier particles having finely-divided toner particles electrostatically clinging to the surface of the carrier particles is conveyed to and rolled or cascaded across the electrostatic latent image-bearing surface. The composition of the toner particles is so chosen as to have a triboelectric polarity opposite that of carrier particles. As the mixture cascades or rolls across the image-bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles as unused toner particles are then recycled. This technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic latent images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brush-like configuration. This "magnetic brush" is engaged with an electrostatic-image bearing surface and the toner particles are drawn from the brush to the electrostatic image by electrostatic attraction.

In magnetic-brush development of electrostatic latent images, the developer is commonly a triboelectric mixture of finely-divided toner powder comprised of dyed or pigmented thermoplastic resin mixed with coarser carrier particles of a soft magnetic material such as "ground chemical iron" (iron filings), reduced iron oxide particles or the like. The conductivity of the ferromagnetic carrier particles which form the "bristles" of a magnetic brush provides the effect of a development electrode having a very close spacing to the surface of the electrophotographic element being developed. By virtue of this development electrode effect, it is possible to develop part of the toners in pictures and solid blacks as well as line copy. Magnetic brush development sometimes makes this mode of developing advantageous where it is desired to copy materials other than simply line copy.

While ordinarily capable of producing good quality images, conventional developing materials suffer serious deficiencies in certain areas. Some developer materials, though possessing desirable properties such as proper triboelectric characteristics, are unsuitable because they tend to cake, bridge and agglomerate during handling and storage. Furthermore, with some polymer coated carrier materials flaking of the carrier surface will cause the carrier to have nonuniform triboelectric properties when the carrier core is composed of a material different from the surface coating thereon. In addition, the coatings of most carrier particles deteriorate rapidly when employed in continuous processes which require the recycling of carrier particles by bucket conveyors partially submerged in the developer supply such as disclosed in U.S. Pat. No. 3,099,943. Deterioration occurs when portions of or the entire coating separates from the carrier core. The separation may be in the form of chips, flakes or entire layers and is primarily caused by fragile, poorly adhering coating material which fails upon impact and abrasive contact with machines parts and other carrier particles. Carriers having coatings which tend to chip and otherwise separate from the carrier core or substrate must be frequently replaced thereby increasing expense and loss of productive time. Print deletion and poor print quality occur when carriers having damaged coatings are not replaced. Fines and grit formed from carrier disintegration tend to drift to and form undesirable and damaging deposits on critical machine parts.

Another factor affecting the stability of the triboelectric properties of carrier particles is the susceptibility of carrier coatings to "toner impaction". When carrier particles are employed in automatic machines and recycled through many cycles, the many collisions which occur between the carrier particles and other surfaces in the machine cause the toner particles carried on the surface to the carrier particles to be welded or otherwise forced onto the carrier surfaces. The gradual accumulation of impacted toner material on the surface of the carrier causes a change in the triboelectric value of the carrier and directly contributes to the degradation of copy quality by eventual destruction of the toner carrying capacity of the carrier. This problem is especially aggravated when the carrier particles, and particularly the carrier cores, are prepared from materials such as iron or steel having a high specific gravity or density since during mixing and the development process the toner particles are exposed to extremely high impact forces from contact with the carrier particles. It is apparent from the descriptions presented above as well as in other development techniques, that the toner is subjected to severe physical forces which tend to break down the particles into undesirable dust fines which become impacted onto carrier particles. Various attempts have been made to decrease the density of the carrier particles and reduce the concentration of the magnetic component by admixture of a lighter material, such as a resin, either in the form of a coating or as a uniform dispersion throughout the body of the carrier granule. This approach is useful in some instances but the amount of such lighter material sufficient to produce a substantial decrease in density has been indicated as seriously diminishing the magnetic response of the carrier particles as to cause a deterioration in the properties of a magnetic brush formed therefrom. One such attempt is disclosed in U.S. Ser. No. 699,030, filed Jan. 18, 1968, wherein the carrier particles comprise a low density, non-magnetic core such as a resin, glass, or the like having coated thereon a thin, continuous layer of a ferromagnetic material. It is therein indicated that a coating of finely powered iron or other subdivided ferromagnetic material does not show the high response to a magnetic field which is displayed by the continuous layers of the invention. Another earlier attempt at low density carrier materials is disclosed in U.S. Pat. No. 2,880,696 wherein the carrier material is composed of particles having a magnetic portion. The core therein may consist entirely of a magnetic material, or it may be formed of solid insulating beads such as glass or plastic having a magnetic coating thereon, or the core may consist of a hollow magnetic ball. However, for unknown reasons, the recited materials have apparently never been commercially successful. Thus, there is a continuing need for a better developer material for developing electrostatic latent images.

SUMMARY OF THE INVENTION

It is, therefore, an object of this invention to provide electrostatographic developer materials which overcome the above-noted deficiencies.

It is another object of this invention to provide a process for preparing magnetically responsive carrier particles which exert reduced impact forces to toner particles.

A further object of this invention is to provide improved developer compositions for use in magnetic brush development.

A still further object of this invention is to provide lower density carrier materials having a magnetic response.

It is another object of this invention to provide developer materials having physical and electrostatographic properties superior to those of known developer materials.

The above objects and others are accomplished in accordance with this invention, generally speaking, by encasing low density silicaceous particles in a sheath of a high purity magnetic or magnetically-attractable metal or metal oxide thereof to provide electrostatographic carrier particles having a low bulk density and a high magnetic permeability. More specifically, low density magnetic composite electrostatographic carrier particles are prepared by the solution phase thermal decomposition of transition metal carbonyls onto low density silicaceous substrates. Magnetically, these composite structures respond like a collection of solid, fine iron particles but, when employed in electrostatographic magnetic brush development systems, form more uniform and "softer" magnetic brushes due to their very low bulk densities which in some cases are more than an order to magnitude less than the density of iron.

In accordance with this invention, transition metal carbonyls are thermo-chemically deposited onto the surface of or into the pores of silicaceous low density substrates to provide low density magnetic composite carrier particles. Magnetic measurements have indicated that the composites are magnetic equivalents to their magnetic constituent, taking into account the significant difference in density between the composite and that of its constituent.

Generally speaking, the low density magnetic composite carrier particles are prepared by applying the metal deposit to the silicaceous beads by the thermal decomposition of a transition metal carbonyl to the elemental metal in the presence of the beads with a suitable suspending medium. For example, glass beads may be covered with magnetic iron by placing them in a suitable vessel with iron pentacarbonyl and a suspending medium such a n-octane. Air and moisture are excluded by displacement with a dry inert gas such as nitrogen, and the contents are heated and stirred so that the iron pentacarbonyl boils, and the mixture is refluxed until the temperature rises to that of the suspending medium whereupon deposition of iron on the beads is complete. The mixture is then cooled, the beads are washed with fresh suspending medium, air dried, and the beads recovered. The magnetic low density spheres obtained typically are highly lustrous.

Thus, the thermal decomposition of typical transition metal carbonyls may be exemplified by the following equations for (1) iron pentacarbonyl, and (2) dicobalt octacarbonyl;

$$Fe(CO_5) \xrightarrow{\Delta} Fe + 5CO \quad (1)$$

$$CO_2(CO)_8 \xrightarrow{\Delta} 2Co + 8CO \quad (2).$$

The decomposition of the transition metals is performed in the presence of silicaceous substrates and utilized to prepare composite materials having both chemical and mechanical stability and which display gross magnetic behavior. Substrate configuration is essentially retained throughout the coating process. The bulk magnetic response of the composite materials may be controlled by varying the mass of the magnetic metal in proportion to the coated particle mass.

Any suitable magnetic or magnetically-attractable transition metal or metal oxide thereof may be employed to cover or impregnate the silicaceous substrates of the low density magnetic composite carrier particles of this invention. Typical such transition metals may be provided from iron pentacarbonyl, di-iron nonacarbonyl, tri-iron dodecacarbonyl, iron carbonyl cluster compounds; dicobalt octacarbonyl, nickel tetracarbonyl, any other thermally extrudable compound of such transition metals, and mixtures thereof. Oxides may be provided by subsequent oxidation of these transition metals.

Any suitable silicaceous material may be employed as the substrate for the composite low density magnetic carrier particles of this invention. Typical silicaceous materials include glass particles in various forms such as hollow glass beads, foam glass nodules, solid glass beads, microporous glass beads, glass chips, ceramic beads, sand, and porcelain. In addition, vitreous materials may also be used. Thus, a wide variety of particulate, low density materials the surface and pores of which can be coated or impregnated with a magnetic or magnetically-attractable transition metal or metal oxide thereof may be employed in accordance with this invention. As indicated, the composite low density magnetic composition of this invention may vary in size and shape. However, it is preferred that the composite material have a spherical shape as to avoid rough edges or protrusions which have a tendency to abrade more easily. Particularly useful results are obtained when the composite material has an average particle size from about 50 microns to about 300 microns, although satisfactory results may be obtained when the composite material has an average particle size of from between about 10 microns and about 850 microns. The size of the carrier particles employed will, of course, depend upon several factors, such as the type of images ultimately developed, the machine configuration, and so forth.

The low density silicaceous material employed as the substrate for the composite magnetic carrier particles of this invention may have any suitable bulk density. Satisfactory results may be obtained when the silicaceous material has an average bulk density of between about 0.2 and about 3.0 grams/cm$^3$. However, it is preferred that the silicaceous material have an average bulk density of less than about 2.5 grams/cm$^3$ because stress levels are substantially reduced thereby reducing toner impaction and developer degradation.

The low density silicaceous material employed as the substrate or matrix for the composite carrier particles of this invention may have a smooth surface, it may have cracks or fissures in the surface, and it may be porous. For example, the low density silicaceous material may be microporous, micro-reticulated beads having an average pore size of from between about 10 A and about 500 A. The low density silicaceous material may have a surface area of up to about 250 m$^2$/gram. When the silicaceous substrate is microporous with open pores, the magnetic metal may be deposited within the pores of the carrier beads in the form of continuous threads or networks which provides a practical advantage in that the magnetic metal is well protected against abrasion. As long as the magnetic metal deposit is substantially continuous around the silicaceous bead or threaded through it, it does not matter for magnetic purposes whether the magnetic material resides on the surface or is impregnated into the interior of the beads as to their performance as magnetic brush development carrier particles. A range of volume ratios of silicaceous material to magnetic elemental metal that will provide satisfactory magnetically-responsive composite carrier particles is from between about 5:1 to 20:1.

To achieve further variation in the properties of the low density magnetic composite carrier particles of this invention, wellknown insulating polymeric resin coating materials may be applied thereto. That is, it may be desirable for some applications to alter and control the conductivity or triboelectric properties of the magnetic composite carrier particles of this invention. Thus, this may be accomplished by applying thereto typical insulating carrier coating materials as described by L. E. Walkup in U.S. Pat. No. 2,618,551; B. B. Jacknow et al in U.S. Pat. No. 3,526,533; and R. J. Hagenbach et al in U.S. Pat. Nos. 3,533,835 and 3,658,500. Typical electrostatographic carrier particle coating materials include vinyl chloride-vinyl acetate copolymers, poly-p-xylyene polymers, styrene-acrylate-organosilicon terpolymers, natural resins such as caoutchouc, colophony, copal, dammar, Dragon's Blood, jalap, storax; thermoplastic resins including the polyolefins such as polyethylene, polypropylene, chlorinated polyethylene, and chlorosulfonated polyethylene; polyvinyls and polyvinylidenes such as polystyrene, polymethylstyrene, polymethyl methacrylate, polyacrylonitrile, polyvinyl acetate, polyvinyl alcohol, polyvinyl butyral, polyvinyl chloride, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides, polycarbonates; thermosetting resins including phenolic resins such as phenolformaldehyde, phenol-furfural and resorcinol formaldehyde; amino resins such as urea-formaldehyde and melamineformaldehyde; polyester resins; epoxy resins; and the like.

When the magnetic composite carrier particles of this invention are overcoated with an insulating resinous material any suitable electrostatographic carrier coating thickness may be employed. However, a polymeric coating having a thickness at least sufficient to form a thin continuous film on the carrier particle is preferred because the carrier coating will then possess sufficient thickness to resist abrasion and prevent pinholes which adversely effect the triboelectric properties of the coating carrier particles. Generally, for cascade and magnetic brush development, the carrier coating may comprise from about 0.1 percent to about 30.0 percent by weight based on the weight of the coated composite carrier particles. Preferably, the carrier coating should comprise from about 0.2 percent to about 2.0 percent by weight based on the weight of the coated carrier particles because maximum durability, toner impaction resistance, and copy quality are achieved.

Any suitable solvent or suspending medium may be employed in the thermal decomposition process of preparing the low density magnetic composite carrier particles of this invention. Typical solvents and suspending mediums may be hydrocarbon solvents with boiling points preferably above that of the transition metal compound employed. Satisfactory results have been obtained with n-octane.

In addition to preparing the low density magnetic composite electrostatographic carrier particles of this invention by solution phase thermal decomposition of transition metal carbonyls, it is also possible to prepare them via chemical vapor deposition using fluidized bed techniques. Thus, magnetic nickel deposits, for example, may be placed on the surface of or in the pores of a low density silicaceous substrate by thermal decomposition of nickel tetracarbonyl in a fluidizing bed apparatus. Typically, such a reactor has a cone-shaped bottom with proportionately-sized capillary tube gas inlets at the apex. To avoid plugging of the apparatus by premature decomposition of the carbonyl, the capillary zone and about one-half of the cone height is usually cooled at heat transfer means. In addition, the top half of the cone and a portion of the reactor is heated to provide the desired temperature to the substrate. In operation, nickel carbonyl vapor is supplied by bubbling a fluidizing gas such as hydrogen through the liquid at room temperature to provide the desired volume percent vapor in the reactant stream. Where desired, carbon monoxide may be added to the reactant stream to suppress gas phase decomposition of the carbonyl. The gas stream from the reactor is then passed through an oil bubbler and burned in a hood to oxidize poisonous carbon monoxide and any unreacted carbonyl vapors as well as to avoid accumulation of explosive mixtures of hydrogen. Preferably, the apparatus is located in a well-ventilated area or in a fume hood to preclude accidental exposure to noxious fumes. Vibrators are preferably attached to the reactor to promote uniformity of coating deposition and aid in returning to the fluidized bed those particles which may adhere to reactor walls above the active bed.

Any suitable well known toner material may be employed with the low density composite carriers of this invention. Typical toner materials include gum copal, gum sandarac, rosin, cumaroneindene resin, asphaltum, gilsonite, phenolformaldehyde resins, rosin modified phenolformaldehyde resins, methacrylic resins, polystyrene resins, polypropylene resins, epoxy resins, polyethylene resins, polyester resins, and mixtures thereof. The particular toner material to be employed obviously depends upon the separation of the toner particles from the magnetic carrier in the triboelectric series and should be sufficient to cause the tone particles to electrostatically cling to the carrier surface. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. Re. 25,136 to Carlson and U.S. Pat. No. 2,788,288 to Rheinfrank et al. These toners generally have an average particle diameter between about 1 and 30 microns.

Any suitable colorant such as a pigment or dye may be employed to color the toner particles. Toner colorants are well known and include, for example, carbon black, nigrosine dye, aniline blue, Calco Oil Blue, chrome yellow, ultramarine blue, Quinoline Yellow, methylene blue chloride, Monastral Blue, Malachite Green Ozalate, lampblack, Rose Bengal, Monastral Red, Sudan Black BM, and mixtures thereof. The pigment or dye should be present in a quality sufficient to render it highly colored so that it will form a clearly visible image on a recording member. Preferably, the pigment is employed in an amount from about 3 percent to about 20 percent by weight based on the total weight of the colored toner because high quality images are obtained. If the toner colorant employed is a dye, substantially smaller quantities of colorant may be used.

Any suitable conventional toner concentration may be employed with the low density magnetic carriers of this invention. Typical toner concentrations for development systems include about 1 part toner with about 10 to about 200 parts by weight of carrier. When employing the low density magnetic carriers of this invention for development of electrostatic latent images, the amount of toner material present should be from between about 10 percent to about 100 percent of the surface area of the carrier particles.

The carrier materials of the instant invention may be mixed with finely-divided toner particles and employed to develop electrostatic latent images on any suitable electrostatic latent image-bearing surface including conventional photoconductive surfaces. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium tri-sulfide, gallium selenide arsenic disulfide, arsenic trisulfide, arsenic triselenide, antimony trisulfide, cadmium sulfoselenide, and mixtures thereof. Typical organic photoconductors include: quinacridone pigments, phthalocyanine pigments, triphenylamine, 2,4-bis(4,4'-diethylaminophenol)-1,3,4-oxadiazol, N-isopropylcarbazole, triphenylpyrrole, 4,5-diphenylimidazolidinone, 4,5-diphenylimidazolidinethione, 4,5-bis(4'-aminophenyl)-imidazolidinone, 1,4-dicyanonaphthalene, 1,4-dicyanonaphthalene, aminophthalocinitrile, nitrophthalodinitrile, 12,3,5,6-tetra-azacyclooctatetraene-(2,4,6,8), 2-mercaptobenzothiazole-2-phenyl-4-diphenylidene-oxazolone, 6-hydroxy-2,3-di(p-methoxyphenyl)-benzofurane, 4-dimethylaminobenzylidene-benzhydrazide, 3-benzylidene-aminocarbazole, polyvinyl carbazole, (2-nitrobenzylidene)-p-bromoaniline, 2,4-diphenyl-quinazoline, 1,2,4-triazine, 1,3-diphenyl-3-methyl-pyrazoline, 2-(4'-dimethylamino phenyl)-benzoxazole, 3-amine-carbazole, and mixtures thereof. Representative patents in which photoconductive materials are disclosed include U.S. Pat. No. 2,803,542 to Ullrich, U.S. Pat. No. 3,121,007 to Middleton, and U.S. Pat. No. 3,151,982 to Corrsin.

The low density magnetic carrier materials produced by the process of this invention provide numerous advantages when employed to develop electrostatic latent images. For example, it has been found that carrier of reduced density reduces levels of mechanical stress in xerographic developer compositions, the reduction resulting in lower toner impaction levels.

In the following examples, iron pentacarbonyl (99.5 percent purity) was obtained from Ventron Corporation, Danvers, Mass. and filtered before use to remove iron oxides. N-octane (practical) was obtained from Eastman-Kodak Company, Rochester, N.Y. and refluxed over sodium for at least 24 hours and distilled before use. Dicobalt octacarbonyl was obtained from Strem Chemical Company, Andover, Mass. Hollow glass spheres were obtained from Emerson and Cuming, Inc., Canton, Mass. under the tradename of "Eccospheres" and were used as received. Porous glass beads were obtained from PPG Industries, Pittsburg, Pa. and were used as received. Similar porous glass particles were obtained from Corning Glass Works, Corning, N.Y. as 7930 glass in the form of chips and were used as received. Material transfers from the pretreatment stages to suspension in a solvent was effected in an inert atmosphere of dry nitrogen.

Thermal decompositions of the carbonyls were carried out in solution in round-bottom flasks with reflux condensor and heating mantle under dry nitrogen at approximately one atmosphere pressure. All decompositions were carried out in vented hoods and in some cases CO effluent was passed through solutions of phosphomolybdic acid in the presence of palladium chloride to afford molybdenum blue and carbon dioxide.

The following examples, other than the control example, further define, describe, and compare preferred methods of preparing and utilizing the low density magnetic composite carriers of the present invention in electrostatographic applications. Parts and percentages are by weight unless otherwise indicated.

EXAMPLE I

A mixture of about 50 ml of hollow glass spheres (FTF-16 Eccospheres) having an average particle diameter of between about 10 and 90 microns, about 60 ml of $Fe(CO)_5$, and about 40 ml of n-octane was refluxed for about 17 hours in a 250 ml flask. After cooling, the suspended solid was collected by filtration, washed with octane, acetone and ethyl ether, and air dried to yield about 40 ml of coated spheres having a bulk density of less than about 0.45 g/cm$^3$. The remaining spheres were clumped to the bottom of the flask.

EXAMPLE II

A mixture of about 480 ml (about 75 g.) of hollow glass spheres (FTD-202 Eccospheres) having an average particle diameter of between about 10 and 100 microns, about 200 ml of $Fe(CO)_5$, and about 500 ml of n-octane was refluxed in a 3 liter, 3-neck flask for about 24 hours with gentle stirring. Approximately 100 g. of dry powder were isolated as in Example I and had a bulk density of less than about 0.02 g/cm$^3$.

EXAMPLE III

A mixture of about 670 ml (about 130 g.) of hollow glass spheres (IG-211 Eccospheres) having an average particle diameter of between about 100 and 125 microns, about 350 ml of $Fe(CO)_5$, and about 800 ml of n-octane was refluxed as in Example II for about 24 hours. About 200 grams of dry coated spheres were isolated as in Example I and had a bulk specific gravity of about 0.41 g/cm$^3$.

EXAMPLE IV

A mixture of about 10 grams of porous glass beads (XO-1, PPG) having an average particle diameter of between about 80 and 150 microns, about 10 ml of $Fe(CO)_5$, and about 50 ml of n-octane was refluxed for about 24 hours in a 300 ml flask. No stirring was provided. Coated bead clumping within the flask was noted and about 5 grams of material was isolated as in Example I. The beads had a brilliant luster.

EXAMPLE V

A mixture of about 20 grams of porous glass beads (XO-1, PPG) having an average particle diameter of between about 80 and 150 microns, about 40 ml of $Fe(CO)_5$, and about 200 ml of n-octane was refluxed in a 500 ml flask for about 24 hours with gentle stirring. Approximately 30 grams of shiny black beads were isolated as in Example I. The beads appeared to be impregnated with iron or an iron oxide.

EXAMPLE VI

A mixture of about 1 gram of glass chips (Corning 7930) having an average particle diameter of between about 90 and 140 microns, about 2 ml of $Fe(CO)_5$, and about 10 ml of n-octane was refluxed in a 50 ml flask for about 2 hours. The contents were filtered after cooling and about 1.2 grams of material was recovered which had a bulk density of about 1 g/cm$^3$. Microscopic examination of the chips at 70× showed a reflective iron coat on the chips. The bulk material appeared black, probably due to high absorption by the multi-reflective chips.

Magnetic measurements were made with a Princeton Applied Research Vibrating Sample Magnetometer, which measures magnetization M, at fields from 0 to 7,000 gauss. The instrument has a sensitivity of better than $1\times10^4$ emu/gauss and the accuracy and resettability of the applied field is within 1 gauss. The system was calibrated with a Ni standard (55.0 emu/gm) in a saturation field of 7 kilogauss. The magnetization, M, is read out digitally, directly in emu's. Mass magnetization, o, was obtained by dividing M by the sample mass in grams. The samples were contained in cylindrical Kel-F holders approximately ¼ inch in diameter and height. The amount of material used, 25 to 35 mg, was varied so that the volume of the sample would remain approximately the same. In the values reported, no attempt was made to account for the bulk shape demagnetization effects of the samples. The magnetization values obtained below the saturation region are the effective values for the above sample configuration. Packing density of the material was assumed to be the same in the hand tamped holder and in an uncompressed but tamped container. The materials of the examples can be efficiently collected into magnetic brushes and manipulated magnetically with a bar magnet or in laboratory magnetic brush fixtures. The magnetic properties of the materials of the examples were characterized as follows.

BRIEF DESCRIPTION OF THE DRAWINGS

The magnetic parameters of the various transition metal coated materials are listed in Table I and the actual magnetization curves obtained with the vibrating sample magnetometer are shown in FIGS. 1 and 2.

TABLE I

| | | Magnetic Parameters of Transition Metal Coated Low Density Substrates | | | | |
|---|---|---|---|---|---|---|
| Example | Description | Saturation $\tau$7000G (emu/g) | Magnetization $\tau$200G (emu/g) | Remanence R (emu/g) | Coercive Force $H_C$ (Gauss) | Permeability $\mu_{eff}$ |
| I | Fe/hollow glass | 100.3 | 49.9 | 4.3 | 14 | 2.5 |
| II | Fe/hollow glass | 48.3 | 32.4 | 14.3 | 30 | 2.2 |
| III | Fe/hollow glass | 71.0 | 32.8 | 3.0 | 14 | 2.1 |
| IV | Fe/porous glass | 37.3 | 17.4 | 1.3 | 14 | — |

TABLE I-continued

| Example | Description | Magnetic Parameters of Transition Metal Coated Low Density Substrates: Saturation $\tau$7000G (emu/g) | Magnetization $\tau$200G (emu/g) | Remanence R (emu/g) | Coercive Force $H_C$ (Gauss) | Permeability $\mu_{eff}$ |
|---|---|---|---|---|---|---|
| V | Fe/porous glass | 26.4 | 5.8 | 3.5 | 90 | — |
| VI | Fe/porous glass | 5.9 | 1.90 | 1.0 | 90 | 1.1 |

The materials of Examples I–IV consist of elemental iron on a borosilicate glass substrate (I–III) or on a pure (99.5 percent) $SiO_2$ substrate (IV). These materials have basically the same magnetic characteristics; that is, high saturation magnetization and initial susceptibility, small remanence and coercive force. Furthermore, the magnetic behavior displayed by these materials is consistent with that of magnetically soft iron. The differences in the saturation magnetization of these materials is due to differences in the iron coating thickness and is illustrated by the approximate scaling of the saturation magnetization with the bulk densities 0.45 0.41 0.20 for the materials of Examples I, III and II, respectively, (decreasing saturation magnetization order) since the density and surface area of the different grades of glass beads used are approximately the same. This order also scales with the relative amount of iron used initially in the reaction mixtures.

The effective permeability, $u_{eff}$, for the materials of these Examples, may be obtained from the initial susceptibility data $\sigma$ and the measured bulk density (calculated within 5 percent) $\rho$ of the materials by the following relation:

$$\mu_{eff}=1+4(M/H)=1+4\pi(\sigma\rho/H)$$

where magnetization, M, is in emu/cm$^3$. Since these magnetically coated materials are spherical, the initial permeability of the individual bead is dependent upon shape demagnetization effects and in this case is limited to a value of 3. However, in the compacted "powder" form in which the beads are measured, particle-particle interactions and the shape demagnetization of the bulk sample can also introduce changes in the effective demagnetization effects. The values listed in Table I fall within the expected range. The high remanence and increased coercive force of the material of Example II are consistent with the very thin and discontinuous coat of iron seen microscopically in this material. Furthermore, the material contained a substantial population of uncoated beads.

Figure 1:
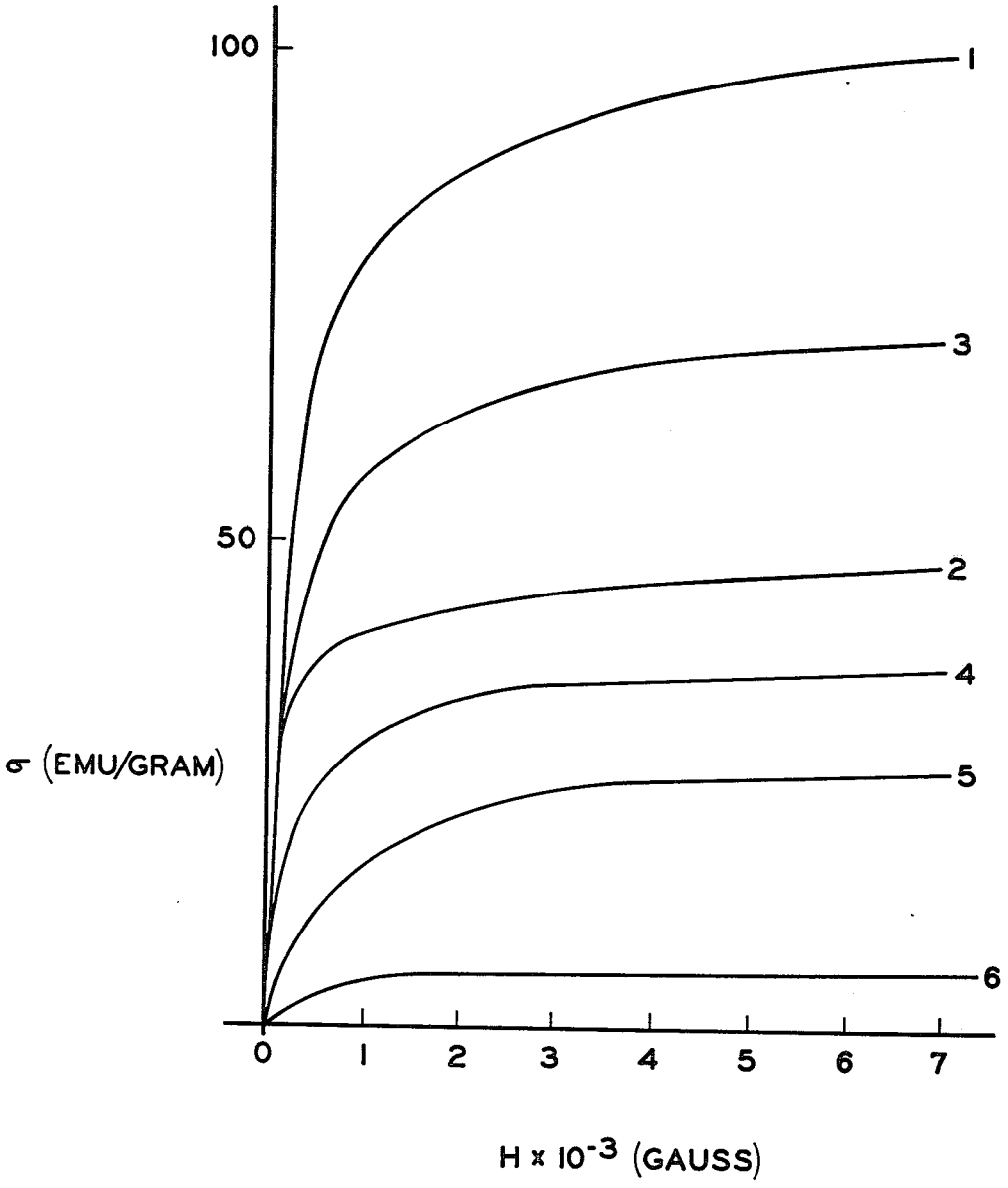
FIG. 1 represents the magnetization curves of the compositions of Examples I through VI and depicts the saturation moment of the compositions in emu/gram over an applied field of 0 to 7,000 gauss. Plateauing of the curves indicates the saturation moment at the high fields.
Figure 2:
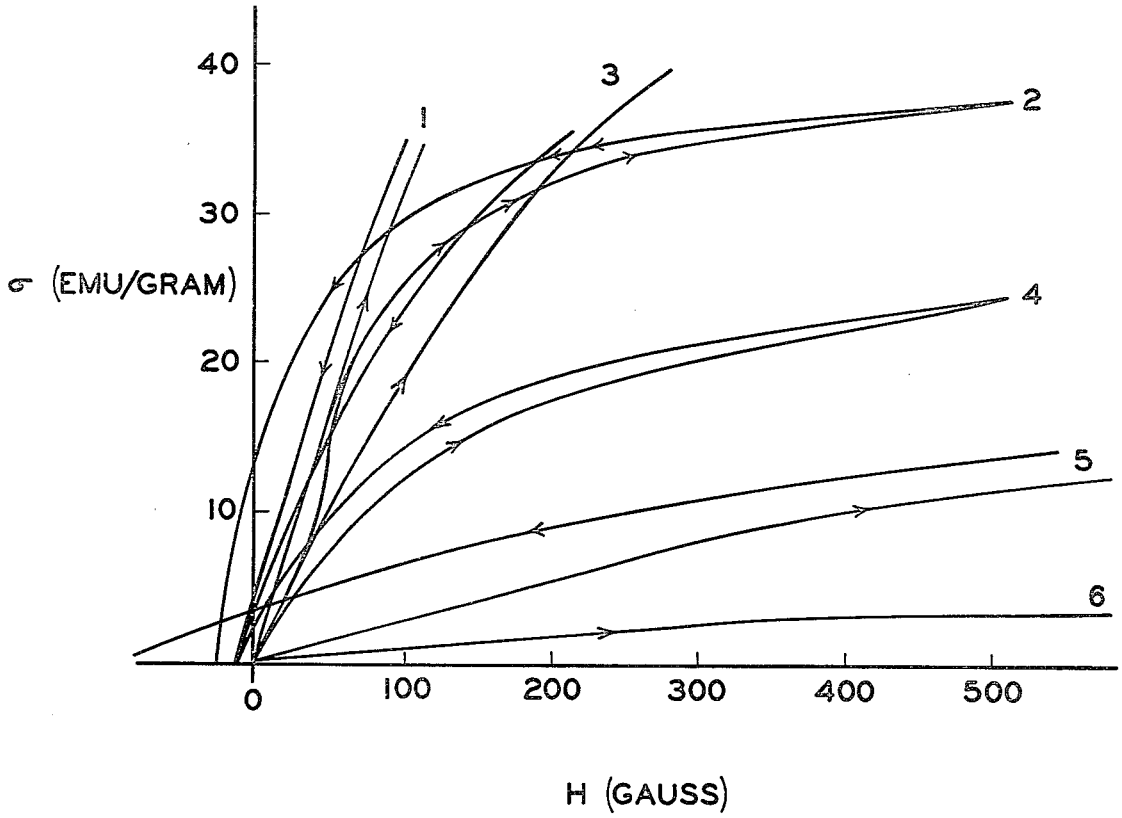
FIG. 2 represents the magnetization curves of the compositions of Examples I through VI and illustrates the hysteresis loops observed for the respective compositions. As illustrated therein, hysteresis loops are observed due to the different return path experienced by the compositions when the applied field is decreased from about 500 to about zero gauss. The arrows on the magnetization curves indicate the direction, i.e., increasing or decreasing, of the applied field in gauss. The field limit of the magnet used was 7 kilogauss and this was taken as the saturation field, although as can be seen in FIG. 1, saturation for some of the samples has still not been attained. Table I is as follows.

The materials of Examples V and VI show a distinct departure in the magnetic parameters (FIG. 2) $X_i$, (initial susceptibility) $\sigma_{sat}$, $\sigma_R$ and $H_c$ from those of Examples I–IV. The initial susceptibility is now quite small and the magnetization shows a very flat approach to saturation at high fields (FIG. 1). In all cases the coercive force $H_c$ has increased significantly. These changes in $X_i$ and $H_c$ for the present Examples reflect the morphological changes in the coating where we are no longer dealing with pure elemental iron. Optical examination of the material of Example VI (glass chips) showed a wide variation in the coating of this material. The material of Example V differed entirely from the other iron coated porous bead material, i.e., Example V, in that no surface coat of elemental iron appeared; rather, the beads appeared impregnated, possibly with black iron oxides. The reason for this change in final material as compared with that of Example IV is not clear. Reaction mixture contamination or reaction time may be responsible. The magnetic changes observed in the materials of Examples V and VI are believed to be due to the different surface compositions, resulting from the formation of discontinuous coating regions of isolated iron or iron oxide particles on the surface of the materials.

From these observations, it may be concluded that the thermal decomposition of transition metal carbonyls such as iron pentacarbonyl onto low density silicaceous substrates produces mechanically and chemically stable composites which have the original substrate configuration, and which, additionally, display gross magnetism. The magnetic behavior observed for these low density magnetic composites ranges from that typical of magnetically soft iron to that typical of magnetically hard cobalt. The composites are, therefore, magnetic equivalents to their magnetic constituent yet afford a drastic reduction in density. The composites show good initial magnetic response (indicated by a relatively high $\mu$) indicating the use of these materials as low density magnetic carrier particles. Further, the various magnetic parameters, $M_s$, $H_c$, $\mu_{eff}$ of the low density magnetic materials can be controlled by varying the preparation and starting components of the materials. This type of control offers a wide lattitude in design parameters not earily achieved with solid or high density magnetic carriers. In addition, there is a direct relationship between the magnetic characteristics of the low density composites and their surface composition and morphology as reflected in the relative values of $X_i$, $M_s$ and $H_c$ for the materials of the various Examples.

EXAMPLES VII–XX

Eight lots of spherical particles coated with chemical vapor deposited nickel from 0.4 to 3 microns thick on solid glass and porous glass; and six lots of spherical particles coated with chemical vapor deposited iron from 0.9 to 1.5 microns thick on solid and porous glass beds were prepared. Coatings and impregnations were prepared by thermal decomposition of the respective carbonyls using fluidized bed techniques. The materials were characterized with respect to coating thickness. Table II summarizes these results.

TABLE II

| Example No. | Substrate[a] | Coating: Material | Coating: Thickness, $\mu$ | Density, g/cm$^3$: Bulk[b] | Density, g/cm$^3$: Absolute[c] | Weight, g |
|---|---|---|---|---|---|---|
| VII | Solid Glass No. 1 | Ni | 1.1 | — | 2.54 | 127 |
| VIII | Solid Glass No. 2 | Ni | 3.0 | — | 2.46 | 330 |
| IX | Solid Glass | Ni | 2.0 | — | — | 460 |
| X | Solid Glass | Ni | 2.5 | — | — | 2,942 |

TABLE II-continued

| Example No. | Substrate[a] | Coating | | Density, g/cm³ | | Weight, g |
|---|---|---|---|---|---|---|
| | | Material | Thickness, μ | Bulk[b] | Absolute[c] | |
| XI | Solid Glass | Ni | 1.8 | — | — | 3,300 |
| XII | Solid Glass | Ni | —[d] | — | — | 3,100 |
| XIII | Porous Glass | Ni | 2.0 | — | 0.8 | 10 |
| XIV | Solid Glass | Ni | 0.4 | 1.518 | 2.504 | 1,800 |
| XV | Solid Glass | Fe | 1.3 | — | — | 81 |
| XVI | Porous Glass | Fe | —[e] | — | — | 27 |
| XVII | Porous Glass | Fe | 1.5 | — | — | 42 |
| XVIII | Porous Glass | Fe | 1.2 | 0.797 | 1.246 | 420 |
| XIX | Porous Glass | Fe | 0.9 | 0.736 | 1.191 | 540 |
| XX | Porous Glass | Fe | 1.0 | 0.772 | 1.256 | 480 |

[a]Solid glass No. 1 "impact beads": 88- by 125-μ beads, Potters Brothers, Inc., Carlstadt, N.J. Solid glass No. 2 GL-5-74: 105- by 149-μ beads, Potters Brothers, Inc., Carlstadt, N.J. Porous glass, XO-5: 100-μ average beads, furnished by Pittsburg Plate Glass Inc., Pittsburg, Pa.
[b]Based on weight of vibratorily compacted known volume of particles.
[c]Determined by xylene pycnometer method.
[d]Rough; no overall coating.
[e]Deposit penetrated substrate; no coating.

Other modifications of the present invention will occur to those skilled in the art upon a reading of the present disclosure. These are intended to be included within the scope of this invention.

What is claimed is:

1. A magnetically-responsive, low density electrostatographic composite carrier particle having an average particle diameter of from between about 10 microns and about 850 microns, said carrier particle comprising a porous silicaceous material having an average bulk density of between about 0.2 and about 3.0 grams/cm³, said silicaceous material being micro-reticulated and having pores with an average pore size of from between about 10 and about 500 Angstroms, wherein said pores of said silicaceous material are impregnated with a magnetic or magnetically-attractable transition metal or metal oxide thereof in the form of connecting networks.

2. A magnetically-responsive, low density electrostatographic composite carrier particle in accordance with claim 1 wherein said silicaceous material has a surface area of up to about 250 m²/gram.

3. A magnetically-responsive, low density electrostatographic composite carrier particle in accordance with claim 1 wherein said silicaceous material and said metal or metal oxide are present in a volume ratio of from between about 5:1 to 20:1.

4. A magnetically-responsive, low density electrostatographic composite carrier particle in accordance with claim 1 wherein said composite carrier particle has an overcoating of an insulating polymeric resin in an amount sufficient to form a thin continuous film thereon.

5. A magnetically-responsive, low density electrostatographic composite carrier particle in accordance with claim 1 wherein said metal or metal oxide is selected from the group consisting of iron, nickel, and cobalt.

6. An electrostatographic developer mixture comprising finely-divided toner particles electrostatically clinging to the surface of a carrier, said carrier comprising a magnetically-responsive, low density electrostatographic carrier particle hving an average particle diameter of from between about 10 microns and about 850 microns, said carrier particle comprising a porous silicaceous material having an average bulk density of between about 0.2 and about 3.0 grams/cm³, said silicaceous material being micro-reticulated and having pores with an average pore size of from between about 10 and about 500 Angstroms, wherein said pores of said silicaceous material are impregnated with a magnetic or magnetically-attractable transition metal or metal oxide thereof in the form of connecting networks, and wherein said toner particles are present in an amount of from between about 10 percent to about 100 percent of the surface area of said carrier particle.

7. An electrostatographic imaging process comprising the steps of providing an electrostatographic imaging member having a recording surface, forming an electrostatic latent image on said recording surface, and contacting said electrostatic latent image with an electrostatographic developer mixture comprising finely-divided toner particles electrostatically clinging to the surface of a carrier, said carrier comprising a magnetically-responsive, low density electrostatographic carrier particles having an average particle diameter of from between about 10 microns and about 850 microns, said carrier particles comprising a porous silicaceous material having an average bulk density of between about 0.2 and about 3.0 grams/cm³, said silicaceous material being micro-reticulated and having pores with an average pore size of from between about 10 and about 500 Angstroms, wherein said pores of said silicaceous material are impregnated with a magnetic or magnetically-attractable transition metal or metal oxide thereof in the form of connecting networks, and wherein said toner particles are present in an amount of from between about 10 percent to about 100 percent on the surface area of said carrier particle, whereby at least a portion of said finely-divided toner particles are attracted to and deposited on said recording surface in conformance with said electrostatic latent image.

* * * * *